United States Patent [19]

Fujii et al.

[11] Patent Number: 4,665,001

[45] Date of Patent: May 12, 1987

[54] NEGATIVELY CHARGEABLE BLUE TONER COMPRISING INDANTHRONE DYE

[75] Inventors: Masanori Fujii, Sakai; Nobuyasu Honda, Tenri; Akira Horiuchi, Shimamoto; Masahiko Kubo, Tenri, all of Japan

[73] Assignee: Mita Industrial Co., Ltd., Osaka, Japan

[21] Appl. No.: 719,583

[22] Filed: Apr. 3, 1985

[30] Foreign Application Priority Data

Apr. 3, 1984 [JP] Japan ..... 59-66981
Nov. 30, 1984 [JP] Japan ..... 59-251660

[51] Int. Cl.[4] ..... G03G 9/00; G03G 9/08; G03G 13/01

[52] U.S. Cl. ..... 430/106; 430/110

[58] Field of Search ..... 430/106, 110

[56] References Cited

U.S. PATENT DOCUMENTS 3,551,137 12/1970 Robinson ..... 430/106
4,078,929 3/1978 Gundlach ..... 430/42
4,539,284 9/1985 Barbetta et al. ..... 430/110

FOREIGN PATENT DOCUMENTS 0166652 12/1980 Japan ..... 430/110
0147151 11/1981 Japan ..... 430/106

*Primary Examiner*—John E. Kittle
*Assistant Examiner*—Mukund J. Shah
*Attorney, Agent, or Firm*—Sherman and Shalloway

[57] ABSTRACT

Disclosed is a negatively chargeable blue toner comprising a fixing resin binder and an indanthrone dye as a coloring and charge controlling agent. The indanthrone dye as the coloring and charge controlling agent may be used advantageously not only singly but also in combination with a halogen-substituted copper phthalocyanine pigment.

8 Claims, No Drawings

NEGATIVELY CHARGEABLE BLUE TONER COMPRISING INDANTHRONE DYE

BACKGROUND OF THE INVENTION (1) Field of the Invention

The present invention relates to a toner for electrophotography. More particularly, the present invention relates to a blue toner which is excellent in the negative chargeability and the sharpness of a formed image.

(2) Description of the Prior Art

A toner formed by dispersing a black pigment such as carbon black in a binder resin medium is ordinarily used for electrophotography. However, with a recently increased demand for color copies, toners formed by dispersing various chromatic coloring agents in binder resin media are gradually being used in the art.

Of these color toners, toners comprising a phthalocyanine pigment such as copper phthalocyanine are mainly used as blue toners from the viewpoint of color sharpness. However, these phthalocyanine pigments tend to be positively charged and hence, they are defective in that they cannot be used for photosensitive plates bearing an electrostatic latent image of positive polarity, such as a selenium photosensitive plate. Of course, it may be considered that this disadvantage will be obviated if a charge controlling agent capable of imparting a negative chargeability to copper phthalocyanine is incorporated. However, incorporation of a large quantity of this charge controlling agent renders the toner per se moisture-sensitive or causes reduction of the electric characteristics of the toner.

Furthermore, there has been proposed and adopted a method in which a phthalocyanine pigment is rendered negatively chargeable by substituting the benzene ring of the basic skeleton of the phthalocyanine with a halogen such as chlorine.

However, this substitution with a halogen often changes the color from blue to green, though negative chargeability can be given by this substitution.

As another method, there is known a method in which a sulfonyl group is introduced into the phthalocyanine ring to effect conversion to a lake. However, in this method, the negative chargeability by friction is insufficient.

SUMMARY OF THE INVENTION

We found that if an indanthrone type dye is used as a colorant for a blue toner, a sharp blue color can be given and the negative chargeability of the toner can be prominently improved.

It is a primary object of the present invention to provide a toner for electrophotography having a good negative chargeability and a sharp blue color.

Another object of the present invention is to provide a blue toner in which the negative chargeability is prominently improved without bad influences on the moisture resistance, flowability and electric characteristics of toner particles.

In accordance with one fundamental aspect of the present invention, there is provided a toner for electrophotography, which comprises a fixing binder resin and an indanthrone dye as a coloring and charge controlling agent.

In accordance with another fundamental aspect of the present invention, there is provided a negatively chargeable blue toner, which comprises a fixing binder resin and a blue pigment comprising at least an indanthrone pigment and a halogen-substituted copper phthalocyanine pigment.

DETAILED DESCRIPTION OF THE INVENTION

The indanthrone dye used in the present invention is a vat dye obtained by subjecting 2-aminoanthraquinone to oxidative condensation in a flux comprising as main components caustic potash and anhydrous sodium acetate and, if necessary, refining the product with sulfuric acid. This dye is called "C. I. Vat Blue (C. I. 69800)", and has a chemical structure represented by the following formula:

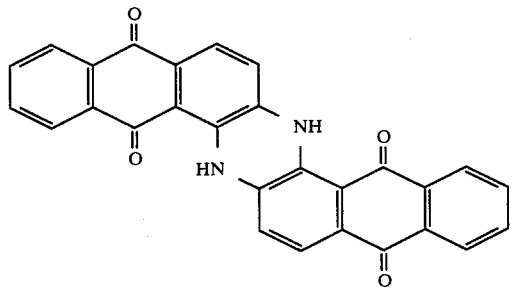

This dye is insoluble in water as well as almost all of the solvent such as alcohols and xylene and is chemically stable; therefore, this dye is especially suitable as a coloring agent for a toner.

Furthermore, this indanthrone dye is characteristic over other blue coloring agents in that it is negatively chargeable by friction.

Table 1 shows results obtained when 10 g of a blue coloring agent is mixed with 90 g of an iron powder carrier (STV-25T supplied by Nippon Teppun K.K.) for 1 hour by a roll mill and the charge quantity (μc/g) is measured by the blow-off method.

TABLE 1

| Tradename | Charge Quantity (μc/g) | Maker | Color Index No. | Name |
|---|---|---|---|---|
| Cyanine Blue FBK | +14.8 | Sanyo Shikiso | 74160 | non-substituted copper phthalocyanine |
| Cyanine Blue J-820 | +6.2 | Sanyo Shikiso | 74160 | non-substituted copper phthalocyanine |
| Cyanine Blue G-314 | +1.3 | Sanyo Shikiso | 74250 | monochloro copper phthalocyanine |
| Cyanine Blue G-500N | +0.2 | Sanyo Shikiso | — | tetrachloro copper phthalocyanine |
| Cyanine Blue PRNC | +3.0 | Toyo Ink | — | sulfonated copper phthalocyanine |
| Threne Blue IRN | −7.4 | Sanyo | 69800 | indathrone |

TABLE 1-continued

| Tradename | Charge Quantity (μc/g) | Maker | Color Index No. | Name |
|---|---|---|---|---|
| | | Shikiso | | |

From the results shown in Table 1, it is seen that the indanthrone dye has exceptionally a negative chargeability as a blue dye, and in the present invention, this characteristic of the indanthrone dye is utilized for a blue toner.

In the toner of the present invention, the indanthrone dye is used in an amount of 2 to 12 parts by weight, preferably 5 to 10 parts by weight, per 100 parts by weight of the fixing binder resin.

All of the thermoplastic and thermosetting resins customarily used in the art may be used as the fixing binder resin. For example, there can be mentioned a styrene resin, an acrylic resin, an olefin resin, a vinyl resin, a saturated polyester resin, a polyamide resin, an alkyd resin, an apoxy resin and a xylene resin. These resins may be used singly or in the form of a mixture of two or more of them. Among these resins, there are preferably used a styrene resin, an acrylic resin and a styrene-acrylic copolymer.

It is preferred that the indanthrone dye be incorporated in an amount as described above into the binder resin. If the amount of the indanthrone dye is too small and outside the above-mentioned range, the negative chargeability and the coloring degree, that is, the image density, are reduced, and if the amount of the indanthrone dye is too large and outside the above range, the cleaning characteristic and fixing property of the toner are degraded.

In accordance with one preferred embodiment of the present invention, a halogen-substituted copper phthalocyanine pigment and an indanthrone pigment are used in combination as the pigment.

In this embodiment, various advantages can be attained by using these two blue pigments in combination. In connection with the hue, a sharp blue color can be obtained by a mingling of the navy blue color of the indanthrone pigment and the green color of the halogen-substituted copper phthalocyanine pigment. Furthermore, in connection with the chargeability, by dint of the negative chargeability of the indanthrone pigment and the relatively neutral chargeability of the halogen-substituted copper phthalocyanine, the chargeability of the entire pigment can be shifted to the negative polarity side. We found that if a toner is formed by using these two pigments in combination and this toner is used for development, a negative chargeability excellent in resistance to the printing operation can be maintained in the toner and this resistance to the printing operation is much superior to those of conventional color toners. As is clearly demonstrated in Examples given hereinafter, after 10 hour's aging, in a toner comprising a sulfonyl group-substituted phthalocyanine pigment as the blue pigment, the negative chargeability is reduced by 3 to 5 μc/g and troubles such as formation of brush marks, tailing and scattering of the toner are caused. On the other hand, reduction of the negative can be controlled to less than 1 μc/g.

The halogen-substituted copper phthalocyanine pigment used in the preferred embodiment of the present invention is represented by the following general formula (1):

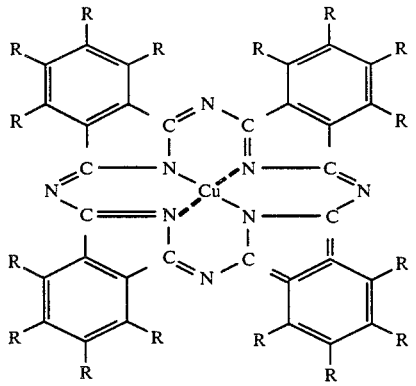

(1)

wherein R stands for a hydrogen or halogen atom, and at least one, preferably 1 to 4, of R's is a halogen atom.

Incidentally, the chargeability of the pigment can optionally be controlled according to the number of halogen substituents in the above general formula (1). More specifically, with an increase in the number of the halogen substituents, the negative chargeability is enhanced, also with an increase in the number of the halogen substituents, the color hue is changed from blue to green. A halogen-substituted copper phthalocyanine pigment of the general formula (1) in which the number of the chlorine substituents is 1 to 4 is especially preferred.

In the present embodiment, 0.5 to 10 parts by weight of the indanthrone dye and 0.5 to 10 parts by weight of the halogen-substituted copper phthalocyanine pigment are incorporated into 100 parts by weight of the fixing resin binder, and the weight ratio of the indanthrone dye to the halogen-substituted copper phthalocyanine pigment is adjusted from 5/1 to 1/5, especially from ½ to 2/1. If the ratio of the indanthrone dye exceeds the above-mentioned range, navy blue is emphasized in the color hue and the toner is not satisfactory as a blue toner. If the ratio of the indanthrone pigment is too low, the negative chargeability is reduced and maintenance of the chargeability becomes difficult.

Known additives customarily used for toners may be added to the toner of the present invention. For example, other coloring agents may be added to adjust the color hue, and an inorganic conducting agent such as a tin oxide-antimony oxide type conducting agent may be added so as to adjust the electric resistance. Moreover, a parting assistant such as a silicone oil, a low-molecular-weight olefin resin or a wax may be added.

It is preferred that the particle size of the toner particles be 3 to 25 microns, preferably 5 to 20 microns. In order to improve the flowability of the toner particles, the surfaces of the toner particles may be sprinkled with fine particles of gas phase method silica or the like according to known procedures.

Preparation of toner particles can be performed by kneading the above-mentioned ingredients uniformly, cooling the kneaded composition and pulverizing the cooled composition, if necessary, followed by classification by sieving. Alternatively, there may be adopted a so-called spray granulation method in which the above-mentioned components are dissolved and dispersed in an organic solvent such as toluene and the dispersed solution is sprayed in a drying atmosphere to effect granulation.

In the electrostatic photographic reproduction process using the toner of the present invention, an electrostatic latent image is formed according to any of known methods. For example, a photoconductive layer of an electroconductive substrate is uniformly charged and is then light-exposed imagewise, whereby an electrostatic latent image is formed.

Development of the electrostatic latent image can be easily accomplished by mixing the toner of the present invention with a magnetic carrier and bringing a magnetic brush of the formed developer into contact with the substrate. The toner image formed by the development is transferred onto a copying sheet and the toner image is fixed by contacting the toner image with a heating roll.

The mixing ratio of the toner to the magnetic carrier is preferably in the range of from 3/100 to 10/100 as in case of ordinary black toners.

The present invention will now be described in detail with reference to the following examples that by no means limit the scope of the invention.

EXAMPLE 1

In a Henschel mixer, 100 parts by weight of a styrene-acrylic copolymer (Pliolite ACL supplied by Goodyear Co.), 8 parts by weight of Thurene Blue IRN and 3 parts by weight of low-molecular-weight polypropylene (550P supplied by Sanyo Kasei K.K.) were uniformly blended, and the mixture was melt-kneaded in a biaxial extruder, naturally cooled and roughly pulverized by a cutting mill. The roughly pulverized composition was finely pulverized to less than about 25 microns by an ultrasonic jet mill and a fraction having a size smaller than 5 microns was cut by a pneumatic classifier to obtain a blue toner having a size of 5 to 25 microns. In order to improve the flowability of the toner, the toner surface was sprinkled with hydrophobic silica (R-972 supplied by Nippon Aerosil K.K.) in an amount of 0.1% by weight based on the total amount.

By means of a roll mill, 80 g of this blue toner was mixed and stirred with 720 g of an iron powder carrier for 1 hour, and when the quantity of the frictional charge of the toner was measured according to the blow-off method, it was found that the frictional charge quantity was −17.7 μc/g. The so-obtained developer was charged in a commercially available dry type copying machine (Model DC-232 supplied by Mita Industrial Co., Ltd.), and while the development bias voltage was kept applied to a developing mechanism and an Se drum, rotation (aging) was continuously conducted for 10 hours, the developer on the developing sleeve was sampled and the frictional charge quantity was measured. It was found that the frictional charge quantity was −16.8 μc/g and the toner concentration was 9.8%.

Separately, 120 g of this blue toner was mixed with 1200 g of an iron powder carrier by a roll mill to form a starter, and the starter was charged in a commercially available dry type copying machine (Model DC-A2 supplied with Mita Industrial Co., Ltd.) and 5000 prints were continuously formed (A-2 size). The first print had a sharp blue image without brush marks or tailing. On the 5000th print, the image quality was not substantially degraded and scattering of the toner was hardly caused. The image densities (I.D.) and fog densities (F.D.) of the first and 5000th prints are shown below.

| | First Print | 5000th Print |
|---|---|---|
| I.D. | 0.95 | 0.93 |
| F.D. | 0.001 | 0.001 |

COMPARATIVE EXAMPLE 1

In the same manner as described in Example 1, a blue toner was prepared from 100 parts by weight of Pliolite ACL, 8 parts by weight of Cyanine Blue G and 3 parts by weight of 550P.

When the aging test was carried out in DC-232 in the same manner as described in Example 1 it was found that the charge quantity of the toner was −10.1 μc/g.

When the copying operation was carried out in the same manner as described in Example 1 by using this toner, fogging was conspicuous and the fog density (F.D.) was as high as 0.1.

EXAMPLE 2

In a Henschel mixer, 100 parts by weight of a styrene-acrylic copolymer (Pliolite ACL supplied by Goodyear Co.), 4 parts by weight of Thurene Blue IRN, 4 parts of weight of Cyanine Blue G-314 and 3 parts by weight of low-molecular-weight polypropylene (550P supplied by Sanyo Kasei K.K.) were uniformly blended, and the mixture was melt-kneaded in a biaxial extruder, naturally cooled and roughly pulverized by a cutting mill. The roughly pulverized composition was finely pulverized to less than about 25 microns by an ultrasonic jet mill and a fraction having a size smaller than 5 microns was cut by a pneumatic classifier to obtain a blue toner having a size of 5 to 25 microns. In order to improve the flowability of the toner, the toner surface was sprinkled with hydrophobic silica (R-972 supplied by Nippon Aerosil K.K.) in an amount of 0.1% by weight based on the total amount.

By means of a roll mill, 80 g of this blue toner was mixed and stirred with 720 g of an iron powder carrier for 1 hour, and when the quantity of the frictional charge of the toner was measured according to the blow-off method, it was found that the frictional charge quantity was −17.4 μc/g. The so-obtained developer was charged in a commercially available dry type copying machine (Model DC-232 supplied by Mita Industrial Co., Ltd.), and while the development bias voltage was kept applied to a developing mechanism and an Se drum, rotation (aging) as continuously conducted for 10 hours, the developer on the developing sleeve was sampled and the frictional charge quantity was measured. It was found that the frictional charge quantity was −16.7 μc/g and the toner concentration was 9.53%.

Separately, 120 g of this blue toner was mixed with 1200 g of an iron powder carrier by a roll mill to form a starter, and the starter was charged in a commercially available dry type copying machine (Model DC-A2 supplied by Mita Industrial Co., Ltd.) and 5000 prints were continuously formed (A-2 size). The first print had a sharp blue image without brush marks or tailing. On the 5000th print, the image quality was not substantially degraded and scattering of the toner was hardly caused. The image densities (I.D.) and fog densities (F.D.) of the first and 5000th prints are shown blow.

| | First Print | 5000th Print |
|---|---|---|
| I.D. | 0.94 | 0.91 |
| F.D. | 0.001 | 0.001 |

EXAMPLE 3

A blue toner was prepared from 100 parts by weight of Pliolite ACL, 4 parts by weight of Thurene Blue IRN, 4 parts by weight of Cyanine Blue G-500N and 3 parts by weight of 550P in the same manner as described in Example 2.

When the aging test was carried out in DC-232, it was found that the toner charge quantity was changed to −17.0 μc/g from −17.9 μc/g and the toner concentration was reduced to 9.6% from 10%, and it was confirmed that the toner was excellent in the maintenance of the charge quantity and scattering of the toner was controlled. When 5000 prints were continuously formed in DC-A2, a sharper image was obtained in each of the 5000 prints without brush marks or tailing.

COMPARATIVE EXAMPLE 2

A blue toner was prepared from 100 parts of Pliolite ACL, 8 parts by weight of Cyanine Blue G-500N and 3 parts by weight of 550P in the same manner as described in Example 2.

When the aging test was carried out in DC-232, it was found that the charge quantity was changed to −14.8 μc/g from −18.8 μc/g and the toner concentration was reduced to 9.3% from 10%.

When the copying test was carried out in a copying machine, formation of brush marks or tailing was not caused, but the color hue was bluish green and it was confirmed that single use of Cyanine Blue G-500N was insufficient in the color hue.

COMPARATIVE EXAMPLE 3

A blue toner was prepared from 100 parts by weight of Pliolite ACL, 8 parts by weight of Cyanine Blue FBK and 3 parts by weight of 550P in the same manner as described in Example 1.

The charge quantity of the toner was as low as −12.0 μc/g even without performing the aging test, and scattering of the toner from the developing sleeve was observed.

COMPARATIVE EXAMPLE 4

A blue toner was prepared from 100 parts by weight of Pliolite ACL, 8 parts by weight of Cyanine Blue PRNC and 3 parts by weight of 550P in the same manner as described in Example 2. From the results of the aging test conducted in a copying machine, it was found that the charge quantity of the toner was changed to −10.0 μc/g from −15.3 μc/g and the toner concentration was reduced to 8.8% from 10%. It was thus confirmed that the charge quantity-maintaining property of the toner was insufficient.

We claim:

1. A negatively chargeable blue toner for use in electrophotography, comprising a fixing resin binder and an indanthrone dye having a chemical structure represented by the following formula:

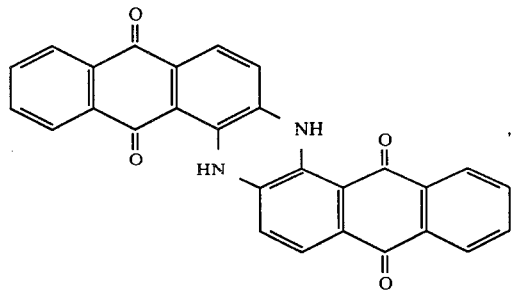

wherein the indanthrone dye is present as a coloring and a charge-controlling agent in an amount of 2 to 12 parts by weight per 100 parts by weight of the fixing binder resin.

2. A negatively chargeable blue toner for use in electrophotography, comprising a fixing resin binder and a blue pigment, wherein the blue pigment comprises at least an indanthrone pigment having a chemical structure represented by the following formula:

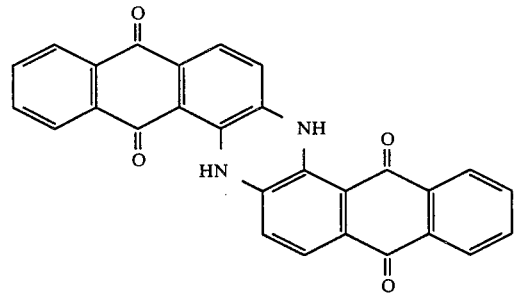

in an amount of 0.5 to 10 parts by weight and a chlorine-substituted copper phthalocyanine pigment in an amount of 0.5 to 10 parts by weight per 100 parts by weight of the fixing resin binder, the weight ratio of the indanthrone pigment to the chlorine-substituted copper phthalocyanine pigment being in the range of from 5/1 to 1/5.

3. A toner as set forth in claim 1 wherein the indanthrone dye is present is an amount of 5 to 10 parts by weight per 100 parts by weight of the fixing binder resin.

4. A toner as set forth in claim 2 wherein the ratio of the indanthrone pigment to the chlorine substituted copper phthalocyanine pigment is from ½ to 2/1.

5. A toner as set forth in claim 1 wherein the particle size is 5 to 20 microns.

6. A toner as set forth in claim 1, wherein the fixing resin binder is a styrene resin, an acrylic resin or a styrene-acrylic copolymer resin.

7. A toner as set forth in claim 1, wherein the particle size of the toner is 3 to 25 microns.

8. A toner as set forth in claim 2, wherein the chlorine-substituted copper phthalocyanine pigment contains 1 to 4 chlorine substituents per molecule.

* * * * *